US006152049A

United States Patent [19]

Schmidt

[11] Patent Number: 6,152,049

[45] Date of Patent: Nov. 28, 2000

[54] VERTICALLY ADJUSTABLE WORK TABLES

[76] Inventor: Rainer Schmidt, An der Haselmauer 2, 56472 Nisterau, Germany

[21] Appl. No.: 09/460,334

[22] Filed: Dec. 10, 1999

[30] Foreign Application Priority Data

Dec. 12, 1998 [DE] Germany ..... 298 22 188

[51] Int. Cl.[7] ..... A47B 9/00

[52] U.S. Cl. ..... 108/147; 248/188.5

[58] Field of Search ..... 108/147, 144.11, 108/14.19; 248/108.5, 188.2, 188.1, 188.6, 404

[56] References Cited

U.S. PATENT DOCUMENTS

| | | | |
|---|---|---|---|
| 610,933 | 9/1898 | Wagoner | 108/147 X |
| 638,755 | 12/1899 | Piper et al. | 108/147 X |
| 3,820,176 | 6/1974 | Feiertag | 108/147 X |
| 4,619,208 | 10/1986 | Kurrasch | 108/147 |
| 4,651,652 | 3/1987 | Wyxkoff | 108/147 |
| 5,400,721 | 3/1995 | Greene | 108/147 |
| 5,421,481 | 6/1995 | Fortmann et al. | 108/147 X |
| 5,598,789 | 2/1997 | Jonker | 108/147 |
| 5,682,825 | 11/1997 | Manner | 108/147 |
| 5,715,759 | 2/1998 | Lee | 108/147 X |
| 5,797,331 | 8/1998 | Watt | 108/147 X |

*Primary Examiner*—Jose V. Chen
*Attorney, Agent, or Firm*—Friedrich Kueffner

[57] ABSTRACT

A vertically adjustable work table includes a lower frame with at least two outer tubes which each form a part a support leg and are spaced apart from each other and are connected to each other, and an upper frame composed of a work plate and two inner tubes guided in the outer tubes. The inner tubes are movable by traction ropes connected to a traction unit, wherein the traction ropes are attached to the top of the lower frame, extend downwardly toward the bottom of the inner tube and are guided from the bottom of the inner tube toward the upper portion of the outer tube and outwardly into the lower frame. The traction unit is provided with a counter traction unit with at least two traction ropes which extend outwardly out of the lower frame and are connected to the top of the upper frame.

5 Claims, 1 Drawing Sheet

Fig.1
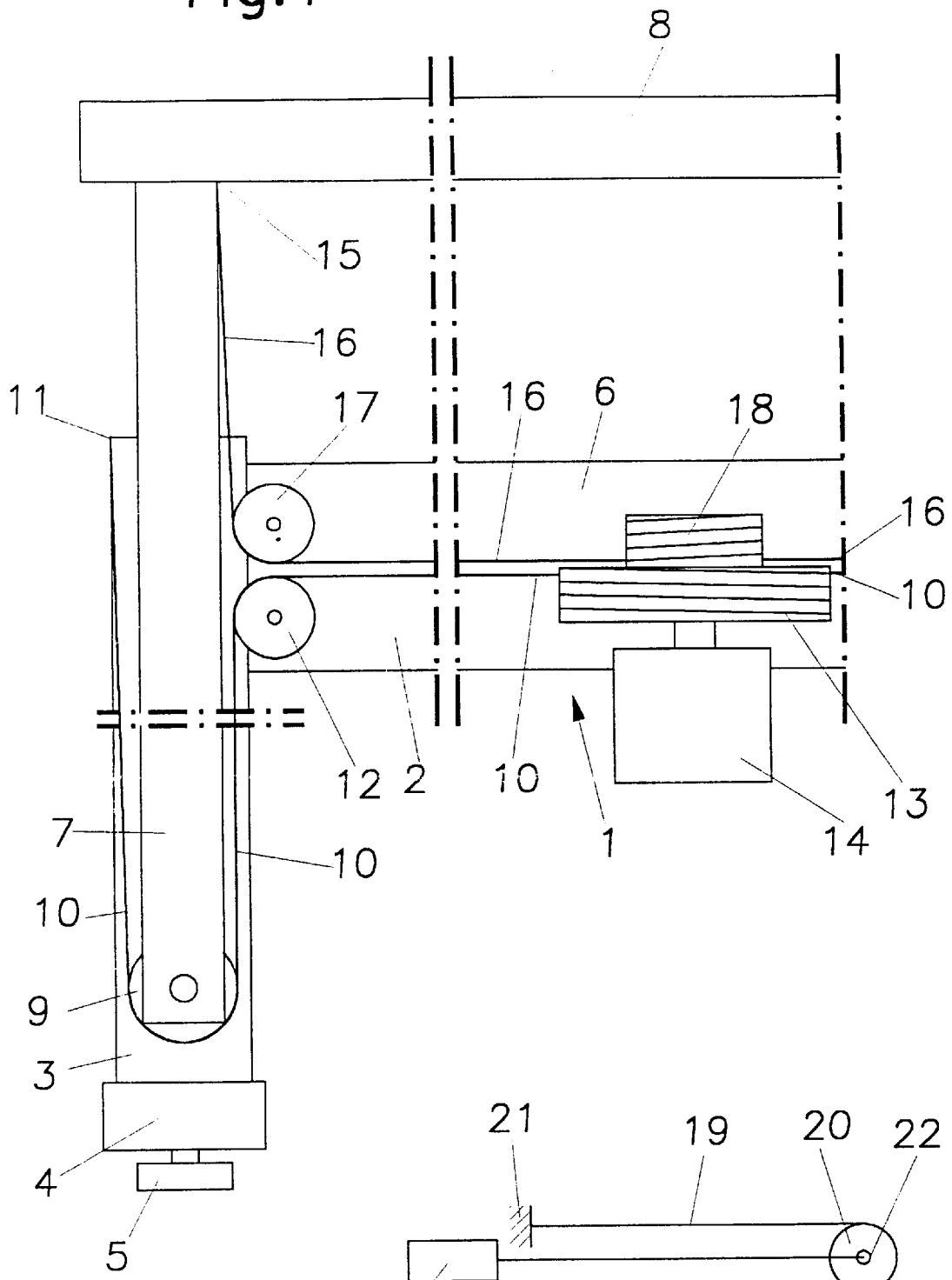
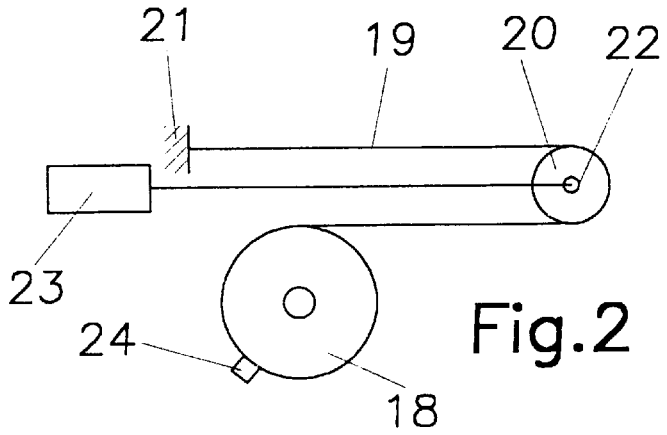
Fig.2

VERTICALLY ADJUSTABLE WORK TABLES

BACKGROUND OF THE INVENTION

1. Field of the Invention

The present invention relates to a vertically adjustable work table with at least two support legs. The work table includes a lower frame with at least two outer tubes which each form a part of one of the support legs and are spaced apart from each other and are connected to each other, and an upper frame composed of a work plate and two inner tubes guided in the outer tubes and also forming parts of the support legs, wherein the inner tubes are movable by means of traction ropes connected to a traction unit, and wherein the traction ropes are attached to the top of the lower frame, extend downwardly toward the bottom of the inner tube and are guided from the bottom of the inner tube toward the upper portion of the outer tube and outwardly into the lower frame.

2. Description of the Related Art

Work tables, which also can be called desks and work benches and which are composed of a metal frame supporting a work plate, are known in the art. The frame is composed of a lower frame which is formed by at least two outer tubes which are connected to each other through a strut and may have different cross-sectional shapes and cross-sectional sizes. Inner tubes are slidably guided in the outer tubes, wherein the inner tubes are connected either exclusively to the work plate or, if necessary, they may be connected through an additional strut. An outer tube and an inner tube always together form a support leg of the work table. In order to be able to change or raise the vertical position of the work plate, a rope is attached to the upper portion of the lower frame, preferably to the upper portion of the outer tube, wherein the rope extends downwardly toward the lower end of the inner tube, is deflected at the lower end of the inner tube and then again extends upwardly and then projects in the upper portion of the outer tube into the lower frame and is received in the lower frame by a traction unit which may be composed, for example, of a rope drum. All of the ropes of the support legs are connected to the traction unit. By appropriately moving the traction unit, the inner tubes are pushed out of the outer tubes gradually, but within predetermined limits, so that the work plate is raised. When the traction unit is moved in the opposite direction, the traction ropes are released and the inner tubes once again move back into the outer tubes as a result of the weight of the upper frame, particularly of the work plate. The traction unit may be moved either manually or by a special drive.

A work table of this type has the disadvantage that the work plate can no longer be lowered if an inner tube is misaligned in an outer tube and becomes jammed. An even greater disadvantage is the fact that, when the work table is to be grasped, for example, at the work plate and is to be carried, the work plate moves upwardly and the inner tubes move out of the outer tubes until the maximum work level of the work plate has been reached. When the work plate is at this vertical position, it is usually no longer possible to carry the work table.

SUMMARY OF THE INVENTION

Therefore, it is the primary object of the present invention to further develop a vertically adjustable work table with at least two support legs in such a way that the inner tubes cannot be misaligned and/or become jammed in the outer tubes, on the one hand, and that it is ensured, on the other hand, that, when the work plate is lifted, for example, for transporting the work table, the position of the work plate relative to the lower frame cannot change and, thus, the inner tubes remain in their position in the outer tubes.

In accordance with the present invention, it is proposed in a vertically adjustable work table of the above-described type that the traction unit is provided with a counter traction unit with at least two traction ropes which extend outwardly out of the lower frame and are connected to the top of the upper frame.

As a result of the configuration of the work table according to the present invention, traction ropes are not only used for raising the work plate, but also for lowering the work plate. As a result, the inner tubes cannot become misaligned or become jammed in the outer tubes. When the work table is to be transported, the work plate can be grasped and the work table can be carried without causing the position of the upper frame relative to the lower frame to be changed.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 1 is a schematic elevational view of a work table according to the present invention; and FIG. 2 is an illustration of a detail showing another embodiment of the unit for moving the work plate of the work table.

DESCRIPTION OF THE PREFERRED EMBODIMENTS

FIG. 1 of the drawing partially shows a work table 1 serving, for example, as a desk. As seen in the drawing, the right portion of the work table, not shown, is constructed identical and mirror-inverted to the left portion.

The work table 1 is composed of a lower frame 2 which includes two outer tubes 3, wherein, however, only one outer tube 3 is shown in the drawing. This outer tube 3 is provided at its lower end with a base plate 4 which is equipped with legs 5 for precisely adjusting the horizontal position. The two outer tubes 3 are connected through a strut 6 and are spaced apart from each other by a predetermined distance. For clarity's sake, this strut 6 is illustrated with a significantly larger dimension with respect to its cross-section or height.

The outer tubes 3 each slidably receive an inner tube 7 through guide means which are not illustrated but are known in the art. The two inner tubes 7 are rigidly connected to each other through a work plate 8. The two inner tubes 7 and the work plate 8 form the so-called upper frame of the work table 1, while an outer tube 3 and an inner tube 7 together form a support leg.

In order to be able to move the inner tubes 7 within the outer tubes 3 and, thus, to change the vertical position of the work plate 8, each inner tube 7 has in its lower portion a guide roller 9, wherein a traction rope 10 extends around the guide roller 9. This traction rope 10 is attached with one end thereof to the upper portion of the lower frame 2, for example, in the upper portion of the outer tube 3 at the point 11. The other end of the traction rope 10 extends over a guide roller 12 and out of the outer tube 3 toward the outside into the area of the strut 6 and is there fastened to a rope drum 13 which forms the so-called traction unit. The traction rope 10 of the support leg which is not illustrated is also guided in the same manner around guide rollers 9, 12 and is attached to the rope drum 13. For winding up the traction ropes 10 on the rope drum 13, the rope drum 13 is provided with a drive 14, for example, an electric drive. As the traction ropes 10 are wound up, the free length of the traction ropes 10 is reduced and this causes the inner tubes 9 to be moved out of the outer tubes 3 and the work plate 8 to be raised. Lowering of the work plate 8 takes place in such a way that the rope drum 13 is rotated by the drive 14 in the opposite direction. The traction ropes 10 are then wound off from the rope drum 13 and the upper frame of the work table 1 composed of the inner tubes 7 and the work plate 8 is lowered as a result of its own weight.

In order to prevent the inner tubes 7 from becoming misaligned or jammed in the outer tubes 3 and to prevent an upward movement of the work plate 8 relative to the lower frame when the work plate 8 is lifted, for example, by hand for transporting the work table 1, a so-called counter traction unit is provided. This counter traction unit is composed of another traction rope 16 which is connected at point 15 to the upper portion of the inner tube 7 and which is also guided into the area of the strut 6 over an additional guide roller 17. The traction rope 16 of each support leg is then attached to another rope drum 18. This rope drum 18 has an effective circumference for the traction ropes 16 which is reduced by half relative to the effective circumference of the rope drum 13. This is because of the fact that, when the work plate 8 is raised or lowered, the traction rope 16 travels a distance which corresponds exactly to the stroke of the work plate 8. However, in the case of the traction rope 10, this distance is exactly twice as large because of the guide roller 9. The inclination of the rope drum 18 extends exactly opposite to the inclination of the rope drum 13. When the work plate 8 is raised by appropriately turning the rope drum 13, the rope drum 18 releases a corresponding length of the traction rope 16. The opposite is true when the work plate 8 is lowered. The traction ropes 16 then force the inner tubes 7 simultaneously and uniformly into the outer tubes 3.

The drive 14 is constructed so as to be self-locking, so that a brake or locking unit is not required. The two guide rollers 12, 17 are usually located in a horizontal plane; however, in order to make the illustration clearer, they are illustrated above each other and spaced apart from each other.

FIG. 2 of the drawing shows a detail of an embodiment of the present invention which does not require a drive 14; however, the embodiment may include a drive 14. In this embodiment, the rope drum 18 includes an additional rope 19 which is guided over a guide roller 20 and is attached to a stationary point 21. A spring 23, for example, a gas spring, acts on the axis 22 of the guide roller 20. The spring 23 is dimensioned in dependence on the weight of the upper frame, such that the work plate can be raised and lowered effortlessly by hand. If this embodiment is equipped with a drive 14, the force of the drive 14 can reinforce the spring 23. However, if no drive 14 is provided, the rope drum 18 is equipped with a locking device 24.

In accordance with a modification of the embodiment explained above, the rope drums 13, 18 can be replaced by translatory traction units, wherein, however, these traction units are constructed in such a way that they release or tension the traction ropes 10, 16 in accordance with the existing step-down ratio.

While specific embodiments of the invention have been shown and described in detail to illustrate the inventive principles, it will be understood that the invention may be embodied otherwise without departing from such principles.

I claim:

1. A vertically adjustable work table with at least two support legs, the work table comprising a lower frame with at least two outer tubes connected to each other at a distance and forming each a part of a support leg, and an upper frame comprised of a work table and two inner tubes each forming another part of one of the support legs and being guided in one of the outer tubes, wherein the inner tubes are movable within the outer tubes by traction ropes, wherein each traction rope is attached to a top of the lower frame, the traction rope extending around a bottom of the inner tube and extending in an upper portion of the outer tube outwardly into the lower frame and being connected to a traction unit mounted in the lower frame, further comprising a counter traction unit mounted in the lower frame with at least two additional traction ropes extending outwardly of the lower frame and attached to a top of the upper frame.

2. The work table according to claim 1, wherein the traction unit is comprised of a rope drum, wherein the counter traction unit is also comprised of a rope drum and is rigidly connected to the rope drum of the traction unit, and wherein the rope drum of the counter traction unit has an effective circumference which is reduced by half relative to an effective circumference of the rope drum of the traction unit, and wherein the rope drums of the traction unit and the counter traction unit have oppositely directed inclinations.

3. The work table according to claim 2, wherein each rope drum comprises a drive.

4. The work table according to claim 2, wherein the rope drum of the counter traction unit comprises a spring.

5. The work table according to claim 4, wherein at least one of the rope drums comprises a locking unit.

* * * * *